United States Patent [19]

Green

[11] 4,272,663

[45] Jun. 9, 1981

[54] METHOD AND APPARATUS FOR COOKING

[76] Inventor: Robert E. Green, 909 N. Front St., Marquette, Mich. 49855

[21] Appl. No.: 65,643

[22] Filed: Aug. 10, 1979

[51] Int. Cl.[3] ..... H05B 6/80

[52] U.S. Cl. ..... 219/10.55 E; 219/10.55 M; 426/243

[58] Field of Search ..... 219/10.55 E, 10.55 F, 219/10.55 R, 10.55 M; 426/241, 243; 99/324, 372

[56] References Cited

U.S. PATENT DOCUMENTS

| | | | |
|---|---|---|---|
| 3,777,099 | 12/1973 | Levinson | 219/10.55 E |
| 3,946,188 | 3/1976 | Derby | 219/10.55 E |
| 4,190,757 | 2/1980 | Turpin et al. | 219/10.55 E |
| 4,210,124 | 7/1980 | Husslein et al. | 219/10.55 E X |

FOREIGN PATENT DOCUMENTS

| | | | |
|---|---|---|---|
| 2432488 | 1/1975 | Fed. Rep. of Germany | 219/10.55 E |
| 52-10937 | 1/1977 | Japan | 219/10.55 E |

*Primary Examiner*—Arthur T. Grimley
*Attorney, Agent, or Firm*—Peck & Peck

[57] ABSTRACT

Method and apparatus for cooking in a microwave oven individual cuts of meat such as rib steaks and prime rib. The implement comprises a base of generally rectangular configuration which is formed of a thermoplastic sheet, such as plexiglass, and is provided adjacent each corner thereof with an upstanding post. The implement also includes a generally rectangular floating member formed of plexiglass having apertures adjacent each corner thereof which are adapted to slideably receive therein the aforementioned posts which are provided on the base of the implement. The individual cut of meat is disposed on the base of the implement and the floating member receives in the apertures thereof, the posts, and floats downwardly on the posts until it is in contact with and resting on the cut of beef to be cooked. The floating member, when in operative position resting upon the cut of beef, permits cooking of the cut of beef around the outer edges thereof leaving the center warm but rarer than the outer edges thereof. The degree of doneness of the cut of beef is determined by the time it is exposed to the microwave energy within the microwave oven. A modification wherein a plurality of cuts of beef may be simultaneously cooked and a plurality of floating members are used, certain of which also function as bases for the cuts of beef.

13 Claims, 4 Drawing Figures

METHOD AND APPARATUS FOR COOKING

BRIEF SUMMARY OF THE INVENTION

The cooking of individual cuts of beef to the doneness desired by the individual customer has presented a problem which is common to all restaurateurs. A part of this problem is the cooking of just the right quantity of cuts of beef to the right degree of doneness to suit the individual customer's taste. It will be evident that a microwave oven substantially reduces the cooking time necessary, but in many instances the connoisseurs of prime rib, for instance, were not satisfied with the way the meat was prepared.

The implement or utensil disclosed in this application makes it possible to cook an individual beef cut dinner in a microwave oven and to control with greater precision than heretofore possible the degree of doneness of the cut of beef. The implement, which will be described hereinafter, provides and insures a method of cooking which duplicates the slow-cook method of a regular oven. As is well-known, and is desirable, the slow-cook method of a regular oven cooks from the outside of the cut in, leaving the center of the cut rarer than the outer edges. The invention herein involved is automatically adapted to cook cuts of beef of varying thickness in a microwave oven and makes it possible to cook cuts of beef of varying thicknesses which duplicate conventional oven cooking of a large standing rib of beef. This implement cooks the individual cut of beef around the outer edges, warming the center of the individual cut while leaving the bulk of the center of the meat unbrowned.

A modification of this invention provides a stacking arrangement whereby the implement may be used to cook a plurality of cuts of beef simultaneously. In this stacking system the implement is provided with more than one floating member and certain of the floating members function not only as a floating member but also as a base for a cut of beef which is supported thereon.

Additional objects and advantages of the present invention will become more readily apparent to those skilled in the art when the following general statements and descriptions are read in the light of the appended drawing.

DETAILED DESCRIPTION

Figure 1:
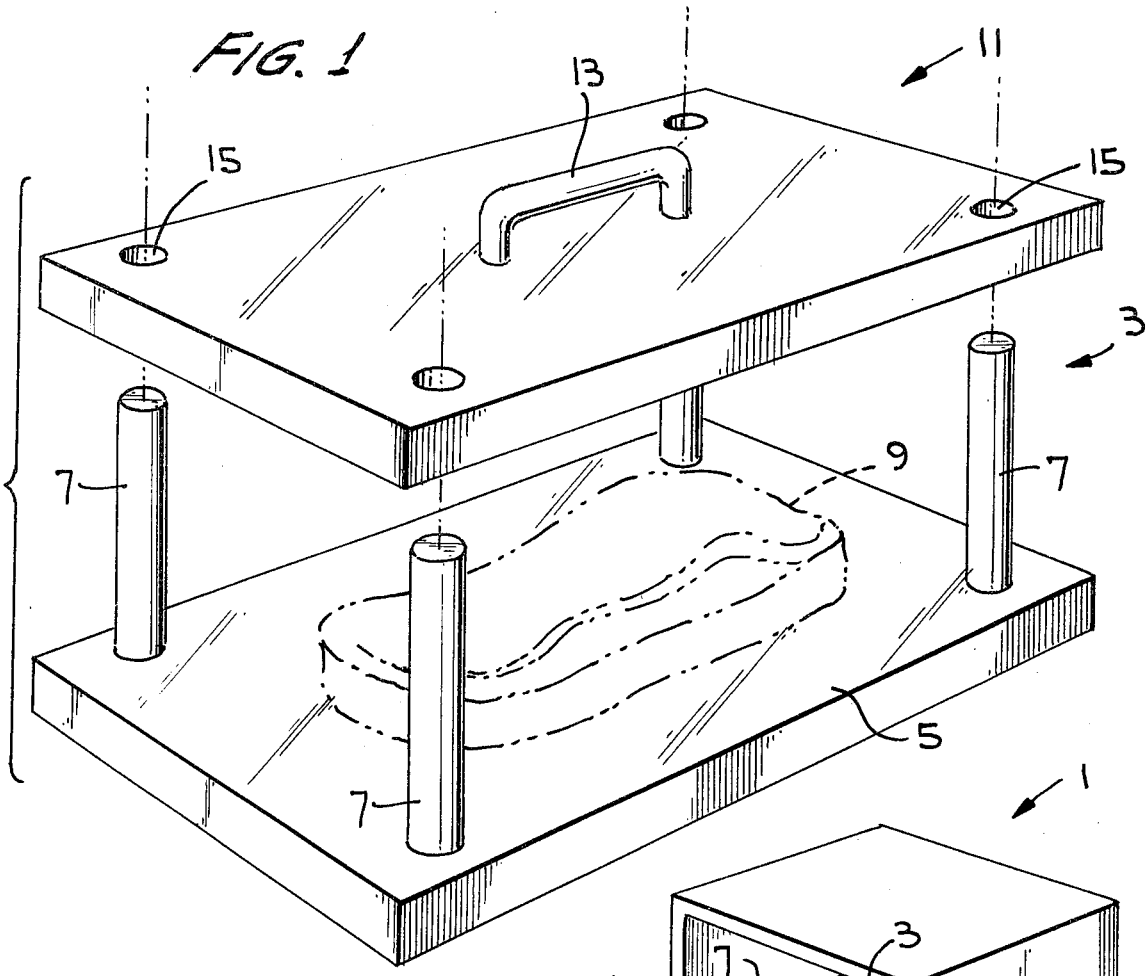
FIG. 1 is an exploded view in perspective of the implement with the floating member in position ready to slideably receive therein the upstanding posts on the base of the implement.

In the accompanying drawing I have used the numeral 1 to designate in its entirety the microwave oven and the numeral 3 to designate the cooking implement in its entirety. As this description proceeds it will be apparent that the implement 3 with a cut of beef thereon to be cooked is disposed in the microwave oven. The implement or utensil 3 comprises a generally rectangular base 5 which is formed of a glassy thermoplastic made by polymerizing acrylic or methacrylic acid or a derivative of either. The base 5 comprises a sheet of the thermoplastic and is sufficiently thick to impart to such a sheet a degree of rigidity. One of the characteristics of the aforesaid sheets of thermoplastic which, as will be explained, resides in the fact that such sheets are merely warmed by the rays of electromagnetic energy which are generated within the microwave oven and are poor conductors of the heat generated in the microwave oven. Such sheets of thermoplastic material comprise the floating members and the base as will be clearly explained. Such sheets of thermoplastic material are conventionally known as "plexiglass." The base 5 is provided adjacent each corner thereof with an upstanding post or rod 7 which is also preferably formed of the thermoplastic material such as plexiglass. It is within my contemplation to provide a groove running around the outer perimeter of the base 5 to catch and hold juices from the cut of beef 9 which is being cooked in the implement within the microwave oven. It is also within my contemplation to provide a pouring spout for such juices at one corner of the aforementioned groove. It will be evident from consideration of the drawings that the base 5 provides a flat plane surface upon which the cut of beef is disposed in the cooking operation, and it is preferable that the base 5 is substantially 1" in thickness.

The utensil or implement comprises what I shall term a "floating member" and this floating member has been designated in its entirety by the numeral 11. The floating member is formed of the same material as the base 5, such as plexiglass and is of generally rectangular configuration to conform to the configuration of the base 5 and is preferably on the order of 1" thickness. A handle 13 of any suitable type is fixed to the floating member 11 so that it may be manipulated for placement of the cut of beef 9 on the base 5 and removed therefrom when the cooking operation is completed. The floating member 11 is provided at each corner thereof with an aperture 15, each of which mates with a post 7. and in operation of the implement the posts 7 which upstand on the base 5 are slideably receivable in the apertures 15 in the floating member.

In the cooking operation a cut of beef 9 is placed on the base 5 as is clearly illustrated in all views of the drawings. The floating member 11 is then positioned so that the posts 7 will be slideably received in the apertures 15 and the floating member then slides down the posts 7 until it is in contact with the cut of beef 9. It will be evident that one of the significant characteristics of this invention resides in this floating member which will accommodate itself to cuts of beef of various thicknesses, and this is automatically accomplished without requiring the services of a chef, or the like. The implement 3 with the cut of beef positioned on the base is then positioned within a microwave oven as illustrated specifically in FIG. 3, the closure member 17 of the oven is closed and the electromagnetic energy is turned on so that the cut of beef 9 will be cooked to the desired doneness. It will be appreciated that the doneness of the cut of beef depends upon the exposure time to which it is subjected within the microwave oven. It is thought to be significant that when the utensil or implement is in operative position as particularly illustrated in FIG. 2 of the drawings, the sides of the cut of beef 9 will be subjected to the electromagnetic energy since the side area adjacent the cut of beef is open and free of any obstructions from the base 5 or the floating member 11, so that a sandwich effect will be created permitting the beef to cook around the outer side edges first, leaving the center of the beef less well done, while the center of the individual beef cut will be warmed but the bulk of the center thereof will be unbrowned, and this results in a closer resemblance to a cut of beef cooked in a conventional oven. It is significant that the floating member 11 which is formed of a thermoplastic material such as plexiglass does not become hot so that the portion of the cut of beef which is engaged by floating member 11 merely becomes warm from the electromagnetic energy.

The same is true of the thermoplastic sheet forming base 5. When the cut of beef 9 has been cooked to the desired degree the handle 13 of the floating member may be grasped and moved upwardly on the posts 7 so that the cut of beef may be removed from the implement or utensil.

Figure 3:
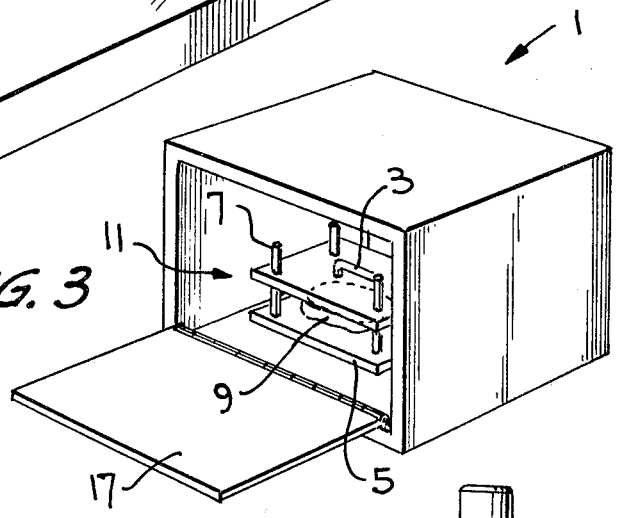
FIG. 3 is a view in perspective illustrating the implement in operative position within the microwave oven.
Figure 4:
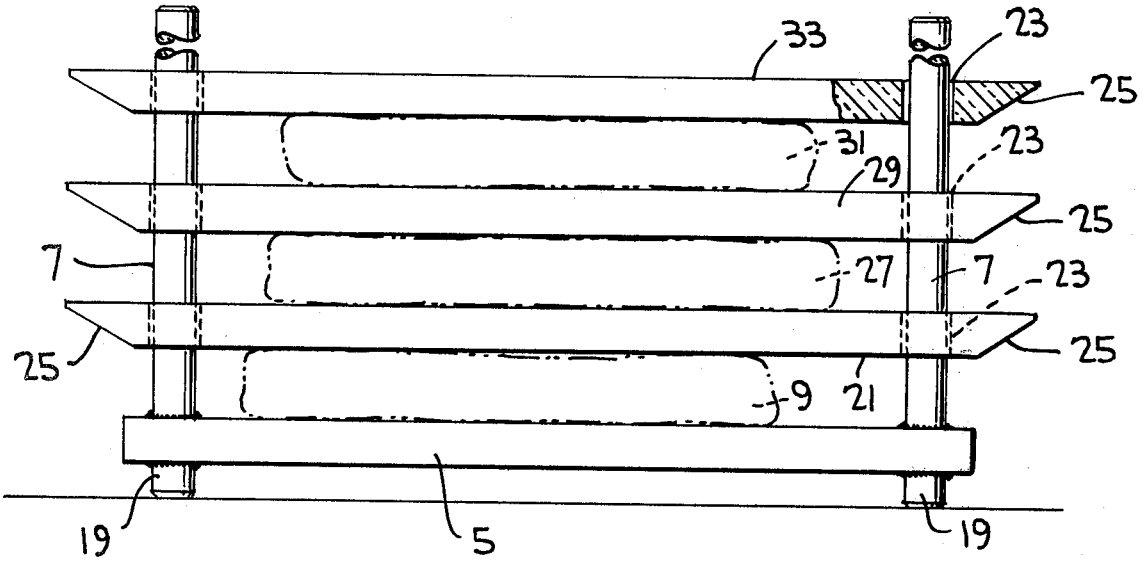
FIG. 4 is an elevational view of a modification of the invention illustrating the stacking system.

In FIG. 4 of the drawings a modified form of this invention is illustrated. In the discussion of this modified form of the invention the same reference numerals will be used for similar parts as those used in FIGS. 1–3 of the drawings. The ingenious form of the invention illustrated in FIG. 4 permits a stacking arrangement whereby a plurality of cuts of beef may be simultaneously cooked to provide cuts of beef having the desirable characteristics of the cut of beef which is cooked singly as illustrated and described in FIGS. 1–3 of the drawings. In this form of the invention the floating members function as the bottom or supporting member for a cut of beef thereabove and also function as the top member for the next adjacent lower cut of beef. It will be appreciated that the stacking arrangement of FIG. 4 which permits the simultaneously cooking of a plurality of cuts of beef is used in a microwave oven as illustrated in FIG. 3 of the drawings, and it will be further recognized that the number of cuts of beef which may be simultaneously cooked in the arrangement of FIG. 4 is dependent upon the depth of the microwave oven 1. It will be evident that the use of a stacking arrangement such a that described in FIG. 4 will result in substantial savings of time, electromagnetic energy, as well as providing better and faster service for the customer.

Figure 2:
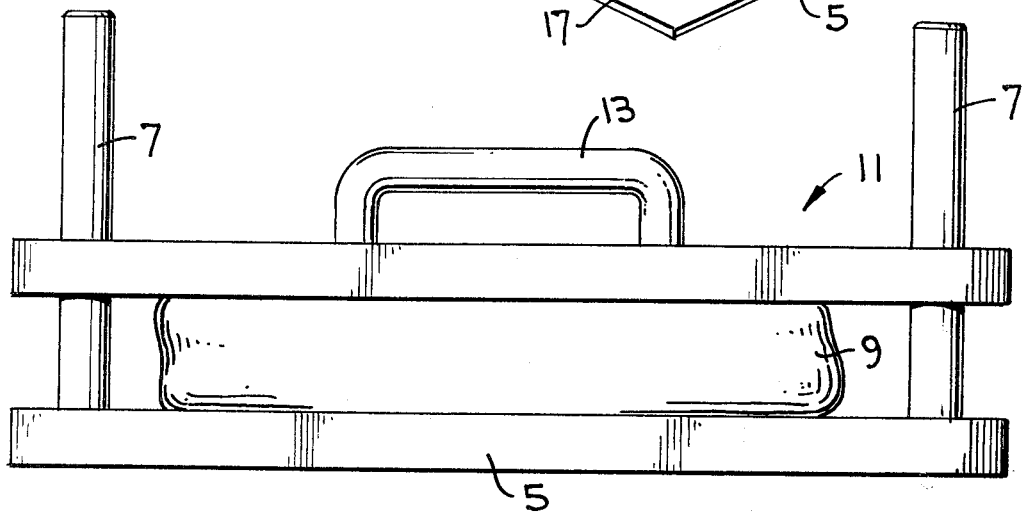
FIG. 2 is a side elevational view illustrating the floating member in position resting upon the cut of beef.

The arrangement described in FIG. 4 provides a base 5 which is preferably formed of the same material as the base 5 illustrated in FIGS. 1–3 of the drawings. Rods 7 are fixed to the base 5 and are in upstanding relation thereto and it is to be understood that a post or rod 7 upstands from each corner of the base 5, all as particularly shown in FIG. 1. Feet 19 are fixed to the base 5 and depend therefrom providing a support for the base and the remainder of the stacking arrangement. The feet 19 are in vertical alignment with the posts or rods 7 and support the entire stacking arrangement in operative position above any supporting surface. A cut of beef 9 is supported on the base 5 and a combination floating member and base 21 is mounted on the post 7 for sliding movement thereon. The combination floating member and base 21 is provided at each corner with an aperture 23 therein so that this combination floating member and base 21 is slideably mounted on the posts. At each end the member 21 is provided with a tapered formation 25 providing a handle arrangement so that the floating member and base 21 may be lifted from its operative position on posts 7. The floating member and base 21 is mounted on the posts 7 and slides downwardly thereon into engagement with the cut of beef 9 which is supported on the base 5. The floating member and base 21 does not function solely to engage and protect the top surface of the cut of beef, but also functions as a base for a further cut of beef 27 which is disposed on the top surface of the member 21. A further combination floating member and base 29 is provided and this member 29 is slideably mounted on the posts in the same manner as the combination floating member and base 21 which has been heretofore described. A cut of beef 31 to be cooked is placed on the upper flat surface of the member 29. 33 comprises a top floating member and is slideably mounted on the post 7 in the same manner as the members 21 and 29. The top floating member 33 slides downwardly on the posts 7 until it is in engagement with the top surface of the cut of beef. It is to be distinctly understood that more combination bases and floating members, such as 21 and 29, may be added to the implement, however, it is to be further understood that the top member 33, regardless of the number of combination bases and floating members, functions solely as a floating member and does not function as a base member. It is also to be clearly understood that the handles on all of the members which are slideably mounted on the posts 7 may take any desirable and suitable form and are not to be limited by the construction 25 which is illustrated in FIG. 4. This structure 25 is shown merely by way of example and is not to be construed as a limitation.

What is claimed is:

1. A cooking implement for cooking a cut of beef in a microwave oven including, in combination, a base formed of a thermoplastic material adapted to receive thereon a cut of beef for cooking, and a floating member formed of thermoplastic material, means upstanding on said base slideably receiving said floating member and said floating member sliding downwardly on said means into operative position in engagement with the cut of beef which is adapted to be disposed on said base, said entire implement being disposed in a microwave oven for cooking the cut of beef.

2. A cooking implement in accordance with claim 1, wherein a cut of beef is provided, said cut of beef being disposed on said base and said entire implement, including cut of beef, being disposed in a microwave oven for cooking the cut of beef.

3. A cooking implement in accordance with claim 2, wherein said base and said floating member are of substantially the same configuration, are dimensionally substantially the same and of substantially the same thickness, and when said floating member is in operative position engaging the cut of beef, the edges of the cut of beef are unobstructed by said base and said floating member and are subjected to electromagnetic energy when said entire implement is disposed within a microwave oven.

4. A cooking implement in accordance with claim 1, wherein said means comprises upstanding posts fixed on said base and said floating member is provided with apertures therein slideably receiving said posts.

5. A cooking implement in accordance with claim 4, wherein a post is provided adjacent each corner of said base and said floating member is provided with an aperture therein adjacent each corner thereof.

6. A cooking implement in accordance with claim 1, wherein said floating member is formed of a glassy thermoplastic sheet characterized by being substantially non-conductive to the heat generated by electromagnetic waves in a microwave oven.

7. A cooking implement for cooking a cut of beef in a microwave oven including, in combination, a base formed of a sheet of thermoplastic material and having a flat upper surface adapted to receive thereon a cut of beef for cooking, and a floating member, means on said base slideably receiving said floating member and said floating member sliding downwardly on said means into operative position in engagement with said cut of beef, said floating member being formed of a sheet of thermoplastic material which becomes warm rather than hot when subjected to electromagnetic energy when the entire implement is disposed in a microwave oven.

8. A cooking implement in accordance with claim 5, wherein said floating member is in engagement with the upper surface of said cut of beef when the floating member is in operative position, and the edges of the cut of beef are subjected to electromagnetic energy.

9. A cooking implement for cooking a plurality of cuts of beef simultaneously in a microwave oven including, in combination, a base formed of a thermoplastic material, a cut of beef to be cooked disposed thereon, a plurality of combination floating members and base members formed of thermoplastic material, a cut of beef to be cooked disposed on each of said combination floating and base members, and each of said combination floating and base members in engagement with the next adjacent lower cut of beef, and a topmost floating member formed of a thermoplastic material and in engagement with the top of the next adjacent cut of beef, means upstanding on said base slideably receiving each of said combination floating and base members and said topmost floating member, said entire implement and cuts of beef being disposed in a microwave oven for simultaneously cooking the cuts of beef.

10. A cooking implement in accordance with claim 9, wherein each of said combination floating and base members and said topmost floating member are formed of a glassy thermoplastic sheet characterized by being substantially non-conductive to the heat generated by electromagnetic waves in a microwave oven.

11. A cooking implement in accordance with claim 10, wherein said base member and said next upwardly adjacent combination floating and base member are spaced apart a distance equal to the thickness of the cut of beef disposed on said base member, and said combination floating and base members are spaced apart a distance equal to the thickness of the cuts of beef disposed thereon, and said uppermost combination floating and base member is spaced from the topmost floating member a distance equal to the thickness of the cut of beef disposed on said combination floating and base member.

12. A method of cooking an individual cut of beef or the like in a microwave oven to resemble an individual serving of beef sliced from a large rib of beef cooked in a conventional oven with the outer edges of the individual cut crisply done but leaving the center of the cut rarer than its outer edges, comprising positioning the individual cut of beef within a microwave oven in a generally horizontal position with its two sides held between the substantially flat surfaces of an upper and a lower sheet of thermoplastic material, the surface area of each surface of the sheets contacting the upper and lower sides of the cut of beef being larger than the surface area of the upper and lower sides of the individual cut, and the upper sheet of thermoplastic material being of sufficient weight to cause the entire surfaces of both sides of the individual cut to be firmly pressed against the upper and lower surfaces, respectively, of the lower and upper thermoplastic sheets.

13. A method in accordance with claim 12, wherein the upper and lower thermoplastic sheets are substantially flat and have a thickness of approximately one inch.

* * * * *